US010482889B2

(12) United States Patent
Setiawan et al.

(10) Patent No.: US 10,482,889 B2
(45) Date of Patent: Nov. 19, 2019

(54) AUDIO SIGNAL PROCESSING APPARATUSES AND METHODS

(71) Applicant: HUAWEI TECHNOLOGIES CO., LTD., Shenzhen, Guangdong (CN)

(72) Inventors: Panji Setiawan, Munich (DE); Karim Helwani, Munich (DE)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 66 days.

(21) Appl. No.: 15/797,007

(22) Filed: Oct. 30, 2017

(65) Prior Publication Data

US 2018/0061425 A1 Mar. 1, 2018

Related U.S. Application Data

(63) Continuation of application No. PCT/EP2015/059476, filed on Apr. 30, 2015.

(51) Int. Cl.
*G10L 19/008* (2013.01)
*H04S 3/00* (2006.01)

(52) U.S. Cl.
CPC ..... *G10L 19/008* (2013.01); *H04S 3/008* (2013.01); *H04S 2400/01* (2013.01); *H04S 2400/03* (2013.01)

(58) Field of Classification Search
CPC combination set(s) only.
See application file for complete search history.

(56) References Cited

U.S. PATENT DOCUMENTS

2003/0039378 A1* 2/2003 Yuasa ..... G06T 7/74 382/104
2008/0052089 A1 2/2008 Takagi
(Continued)

FOREIGN PATENT DOCUMENTS

JP 2005352396 A 12/2005
JP 2015509212 A 3/2015
WO WO 2013120510 8/2013

OTHER PUBLICATIONS

International Search Report, dated Jan. 28, 2016, in International Application No. PCT/EP2015/059476 (2 pp.).
(Continued)

*Primary Examiner* — Duc Nguyen
*Assistant Examiner* — Assad Mohammed
(74) *Attorney, Agent, or Firm* — Conley Rose, P.C.

(57) ABSTRACT

The invention relates to audio signal processing apparatuses and methods, such as an audio signal downmixing apparatus (105) for processing an input audio signal comprising a plurality of input channels (113) into an output audio signal comprising a plurality of primary output channels (123) and at least one auxiliary output channel (125) using a downmix matrix D, wherein the downmix matrix D comprises a primary downmix matrix $D_U$ providing the plurality of primary output channels (123) and an auxiliary downmix matrix $D_W$ providing the at least one auxiliary output channel (125). The audio signal downmixing apparatus (105) comprises an auxiliary downmix matrix determiner (107) configured to determine the auxiliary downmix matrix $D_W$, and a processor (109) configured to process the input audio signal into the output audio signal using the downmix matrix D.

16 Claims, 3 Drawing Sheets

(56) References Cited

U.S. PATENT DOCUMENTS

| | | | | |
|---|---|---|---|---|
| 2014/0126745 | A1* | 5/2014 | Dickins | H04R 3/002 381/94.3 |
| 2014/0355767 | A1 | 12/2014 | Virette et al. | |
| 2014/0358567 | A1 | 12/2014 | Koppens et al. | |
| 2015/0142427 | A1* | 5/2015 | Terentiv | G10L 19/008 704/226 |

OTHER PUBLICATIONS

Dai Yang et al., *High-Fidelity Multichannel Audio Coding With Karhunen-Loève Transform*, IEEE Transactions on Speech and Audio Processing, vol. 11, No. 4, July 2003, pp. 365-380.

Gerard Hotho et al., *A Backward-Compatible Multichannel Audio Codec*, IEEE Transactions on Audio, Speech, and Language Processing, vol. 16, No. 1, January 2008, pp. 83-93.

Manuel Briand et al., *Parametric Representation of Multichannel Audio Based on Principal Component Analysis*, Audio Engineering Society, 120th convention, May 20-23, 2006, XP40507707, pp. 1-14.

International Search Report, dated Jan. 28, 2016, in International Application No. PCT/EP2015/059476 (5 pp.).

Written Opinion of the International Searching Authority, dated Jan. 28, 2016, in International Application No. PCT/EP2015/059476 (6 pp.).

Notice of Allowance, dated Oct. 15, 2018, in Japanese Application No. 2017556547 (3 pp.).

* cited by examiner

AUDIO SIGNAL PROCESSING APPARATUSES AND METHODS

CROSS-REFERENCE TO RELATED APPLICATIONS

This application is a continuation of International Application No. PCT/EP2015/059476, filed on Apr. 30, 2015, the disclosure of which is hereby incorporated by reference in its entirety.

TECHNICAL FIELD

The present invention relates to audio signal processing apparatuses and methods. In particular, the present invention relates to audio signal processing apparatus and method for downmixing and upmixing an audio signal.

BACKGROUND

The art of sound coding, transmission, recording, mixing and reproduction has been a continuous topic of research and development for many decades. Starting from the monophonic technology, technologies on multichannel audio have been gradually extended to include stereophonic, quadrophonic, 5.1 channels and the like. Compared with traditional mono or stereo audio, multichannel audio provides end users with a more compelling listening experience and, thus, becomes more and more appealing to audio producers.

For multichannel audio to be successful it should be possible to reproduce multichannel audio on a legacy playback device supporting only a subset M of an arbitrary number of recording channels Q. The subset of M reproduction channels, for instance, loudspeakers or headphones, in the playback device may change according to the user's need. This may happen when the user switches his device, e.g., from stereo to 5.1 or from stereo to any 3 loudspeaker devices.

The conventional way of reproducing multichannel audio on a legacy playback device is by using a fixed downmix matrix for downmixing the Q channel audio input signal into an audio output signal having only M channels. This can be done at the sender or the receiver side, which is constrained by the popular content format available, such as stereo, 5.1 and 7.1. To date, it is not possible for any playback device to support an arbitrary number of output channels in an optimal and flexible way without prior information regarding the reproduction layout, no feedback to recording device, e.g., plug and play stereo to 3.0, stereo to 8.2, etc.

Thus, there is a need for an improved audio signal processing apparatus and method, in particular an improved audio signal processing apparatus and method allowing for an adaptive reproduction of an audio output signal.

SUMMARY

It is an object of the invention to provide an improved audio signal processing apparatus and method, in particular an improved audio signal processing apparatus and method allowing for an adaptive reproduction of an audio output signal.

This object is achieved by the subject matter of the independent claims. Further implementation forms are provided in the dependent claims, the description and the figures.

According to a first aspect the invention relates to an audio signal downmixing apparatus for processing an input audio signal comprising a plurality of input channels into an output audio signal comprising a plurality of primary output channels and at least one auxiliary output channel using a downmix matrix D, wherein the downmix matrix D comprises a primary downmix matrix $D_U$ for providing the plurality of primary output channels and an auxiliary downmix matrix $D_W$ for providing the at least one auxiliary output channel. The audio signal downmixing apparatus comprises an auxiliary downmix matrix determiner configured to determine the auxiliary downmix matrix $D_W$ by computing a plurality of eigenvectors of a covariance matrix COV defined by the plurality of input channels of the input audio signal, determining for at least one eigenvector of the plurality of eigenvectors of the covariance matrix COV a subspace angle between the at least one eigenvector and a vector defined by a column of the primary downmix matrix $D_U$, selecting at least one eigenvector from the plurality of eigenvectors based on the subspace angle and a preset threshold angle $\theta_{MIN}$, and defining at least one column of the auxiliary downmix matrix $D_W$ by the at least one selected eigenvector. The audio signal downmixing apparatus further comprises a processor configured to process the input audio signal into the output audio signal using the downmix matrix D.

Thus, an improved audio signal processing apparatus is provided allowing for an adaptive reproduction of an audio output signal.

The primary downmix matrix $D_U$ defines a subspace U of the space defined by the downmix matrix D. The auxiliary downmix matrix $D_W$ defines a subspace W of the space defined by the downmix matrix D. The subspace angle between the subspace U and the subspace W is defined as the minimum angle between all vectors spanning the subspace U and all vectors spanning the subspace W.

In a first possible implementation form of the first aspect of the invention, the auxiliary downmix matrix determiner is configured to determine the subspace angle by determining the smallest angle of a plurality of angles between each eigenvector of the plurality of eigenvectors of the covariance matrix COV and the plurality of vectors defined by the columns of the primary downmix matrix $D_U$.

In a second possible implementation form of the first implementation form of the first aspect of the invention, the auxiliary downmix matrix determiner is configured to select eigenvectors from the plurality of eigenvectors based on the subspace angle and the preset threshold angle $\theta_{MIN}$ by selecting eigenvectors, for which the subspace angles are bigger than the preset threshold angle $\theta_{MIN}$. The selection based on a subspace angle analysis guarantees that the selected eigenvectors are not representing a subspace which is a subset of the existing subspaces spanned by the column vectors of the primary downmix matrix $D_U$ (no redundant information is being selected), and a degree of importance of the information contained in the selected eigenvectors can be derived by the obtained subspace angle.

In a third possible implementation form of the first aspect of the invention as such or the first or second implementation form thereof, the size of the primary downmix matrix $D_U$ is determined by the number of input channels of the input audio signal and the number of primary output channels of the output audio signal.

In a fourth possible implementation form of the first aspect of the invention as such or any one of the first to third implementation form thereof, the size of the auxiliary downmix matrix $D_W$ is determined by the number of input channels of the input audio signal and by the number of auxiliary output channels of the output audio signal.

In a fifth possible implementation form of the first aspect of the invention as such or any one of the first to fourth implementation form thereof, the audio signal downmixing apparatus further comprises a primary downmix matrix determiner configured to determine the primary downmix matrix $D_U$ on the basis of a fixed beamformer method or an adaptive beamformer method. This implementation form provides flexibility in terms of choosing a stable desired image of the primary output channels.

In a sixth possible implementation form of the first aspect of the invention as such or any one of the first to fifth implementation form thereof, the processor is configured to process the input audio signal for each of the plurality of input channels in form of a plurality of input audio signal time frames and wherein the processor is further configured to process the input audio signal by determining for each of the plurality of input channels discrete Fourier transforms of the plurality of input audio signal time frames resulting in a plurality of Fourier coefficients at a plurality of frequency bins for the plurality of input audio signal time frames and the plurality of input channels of the input audio signal.

In a seventh possible implementation form of the sixth implementation form of the first aspect of the invention, the auxiliary downmix matrix determiner is configured to determine the auxiliary downmix matrix $D_W$ by determining coefficients $c_{xy}$ of the covariance matrix COV for a given input audio signal time frame n of the plurality of input audio signal time frames and for a given frequency bin j of the plurality of frequency bins using the following equation:

$$c_{xy}(n,j)=E\{j_x j_y^*\}$$

where E{ } denotes an expectation operator, $j_x$ denotes a Fourier coefficient at frequency bin j for input channel x of the input audio signal, * denotes the complex conjugate and x and y range from 1 to the number of input channels.

In an eighth possible implementation form of the seventh implementation form of the first aspect of the invention, the auxiliary downmix matrix determiner is configured to determine the auxiliary downmix matrix $D_W$ by determining coefficients $c_{xy}$ of the covariance matrix COV for a given input audio signal time frame n of the plurality of input audio signal time frames and for a given frequency bin j of the plurality of frequency bins using the following equation:

$$c_{xy}(n,j)=\beta\cdot c_{xy}(n-1,j)+(1-\beta)\cdot\hat{c}_{xy}(n,j)$$

where β denotes a forgetting factor with $0\leq\beta<1$, $\hat{c}_{xy}(n,j)$ denotes the real part of $E\{j_x j_y^*\}$, $j_x$ denotes a Fourier coefficient at frequency bin j for input channel x of the input audio signal, * denotes the complex conjugate and x and y range from 1 to the number of input channels.

In a ninth possible implementation form of the first aspect of the invention as such or any one of the first to eighth implementation form thereof, the auxiliary downmix matrix determiner is configured to compute the plurality of eigenvectors of the covariance matrix COV defined by the plurality of input channels of the input audio signal by means of an eigenvalue decomposition of the covariance matrix COV.

In a tenth possible implementation form of the first aspect of the invention as such or any one of the first to ninth implementation form thereof, the plurality of input channels comprise Q input channels, the plurality of primary output channels comprise M primary output channels and the at least one auxiliary output channel comprises up to Q-M auxiliary output channels.

According to a second aspect the invention relates to an audio signal downmixing method for processing an input audio signal comprising a plurality of input channels into an output audio signal comprising a plurality of primary output channels and at least one auxiliary output channel using a downmix matrix D, wherein the downmix matrix D comprises a primary downmix matrix $D_U$ for providing the plurality of primary output channels and an auxiliary downmix matrix $D_W$ for providing the at least one auxiliary output channel. The audio signal downmixing method comprises the steps of: determining the auxiliary downmix matrix $D_W$; and processing the input audio signal into the output audio signal using the downmix matrix D. The step of determining the auxiliary downmix matrix $D_W$ comprises: computing a plurality of eigenvectors of a covariance matrix COV defined by the plurality of input channels of the input audio signal; determining for at least one eigenvector of the plurality of eigenvectors of the covariance matrix COV a subspace angle between the at least one eigenvector and a vector defined by a column of a primary downmix matrix $D_U$; selecting at least one eigenvector from the plurality of eigenvectors based on the subspace angle and a preset threshold angle $\theta_{MIN}$; and defining at least one column of the auxiliary downmix matrix $D_W$ by the at least one selected eigenvector.

The audio signal downmixing method according to the second aspect of the invention can be performed by the audio signal downmixing apparatus according to the first aspect of the invention. Further features of the audio signal downmixing method according to the second aspect of the invention result directly from the functionality of the audio signal downmixing apparatus according to the first aspect of the invention and its different implementation forms.

According to a third aspect the invention relates to an encoding apparatus comprising an audio signal downmixing apparatus according to the first aspect of the invention, an encoder A configured to encode the plurality of primary output channels of the output audio signal for obtaining a plurality of encoded primary output channels in the form of a first bit stream and another encoder B configured to encode the at least one auxiliary output channel of the output signal for obtaining at least one encoded auxiliary output channel in the form of a second bit stream.

According to a fourth aspect the invention relates to an audio signal upmixing apparatus for processing an input audio signal comprising a plurality of primary input channels and at least one auxiliary input channel into an output audio signal using an upmix matrix, wherein the upmix matrix comprises a primary upmix matrix and an auxiliary upmix matrix. The audio signal upmixing apparatus comprises an auxiliary upmix matrix determiner configured to determine the auxiliary upmix matrix by: obtaining a plurality of eigenvectors of a covariance matrix COV of the input audio signal; determining for at least one eigenvector of the plurality of eigenvectors of the covariance matrix COV a subspace angle between the at least one eigenvector and a vector defined by a column of the primary upmix matrix; selecting at least one eigenvector from the plurality of eigenvectors based on the subspace angle and a preset threshold angle $\theta_{MIN}$; and defining at least one column of the auxiliary upmix matrix by the at least one selected eigenvector; and a processor configured to process the input audio signal into the output audio signal using the upmix matrix.

According to a fifth aspect the invention relates to an audio signal upmixing method for processing an input audio signal comprising a plurality of primary input channels and at least one auxiliary input channel into an output audio signal using an upmix matrix, wherein the upmix matrix comprises a primary upmix matrix and an auxiliary upmix matrix. The audio signal upmixing method comprises the steps of: determining the auxiliary upmix matrix; and processing the input audio signal into the output audio signal using the upmix matrix. The step of determining the auxiliary upmix matrix comprises: obtaining a plurality of eigenvectors of a covariance matrix COV of the input audio signal; determining for at least one eigenvector of the plurality of eigenvectors of the covariance matrix COV a subspace angle between the at least one eigenvector and a vector defined by a column of the primary upmix matrix; selecting at least one eigenvector from the plurality of eigenvectors based on the subspace angle and a preset threshold angle $\theta_{MIN}$; and defining at least one column of the auxiliary upmix matrix by the at least one selected eigenvector.

The audio signal upmixing method according to the fifth aspect of the invention can be performed by the audio signal upmixing apparatus according to the fourth aspect of the invention. Further features of the audio signal upmixing method according to the fifth aspect of the invention result directly from the functionality of the audio signal upmixing apparatus according to the fourth aspect of the invention.

Preferably, the audio signal upmixing apparatus receives the covariance matrix COV via a bit stream from an audio signal downmixing apparatus. In an embodiment the audio signal upmixing apparatus can receive the eigenvectors of the covariance matrix COV, or a selected subset thereof, instead of the covariance matrix COV itself via the bit stream from the audio signal downmixing apparatus. In the first case, the plurality of eigenvectors are obtained from the received covariance matrix, in the second case the plurality of eigenvectors are directly received.

The primary upmix matrices are preferably the same or similar ones as used by the primary downmix matrices and they are either pre-defined in case of fixed beamformer method or they can also be obtained via the bit stream from the audio signal downmixing apparatus in case of adaptive beamformer method.

According to a sixth aspect the invention relates to a decoding apparatus comprising an audio signal upmixing apparatus according to the fourth aspect of the invention, a decoder A configured to receive a first bit stream from an encoding apparatus according to the third aspect of the invention, and to decode the first bit stream to obtain a plurality of primary input channels to be processed by the audio signal upmixing apparatus; and another decoder B configured to receive a second bit stream from the encoding apparatus according to the third aspect of the invention, and to decode the second bit stream to obtain at least one auxiliary input channel to be processed by the audio signal upmixing apparatus.

According to a seventh aspect the invention relates to an audio signal processing system, comprising an encoding apparatus according to the third aspect of the invention and a decoding apparatus according to the sixth aspect of the invention, wherein the encoding apparatus is configured to communicate at least temporarily with the decoding apparatus.

According to an eighth aspect the invention relates to a computer program comprising a program code for performing an audio signal downmixing method according to the second aspect of the invention and/or an audio signal upmixing method according to the fifth aspect of the invention when executed on a computer.

The invention can be implemented in hardware and/or software.

BRIEF DESCRIPTION OF THE DRAWINGS

Further embodiments of the invention will be described with respect to the following figures, in which.

DETAILED DESCRIPTION OF EMBODIMENTS

In the following detailed description, reference is made to the accompanying drawings, which form a part of the disclosure, and in which are shown, by way of illustration, specific aspects in which the disclosure may be practiced. It is understood that other aspects may be utilized and structural or logical changes may be made without departing from the scope of the present disclosure. The following detailed description, therefore, is not to be taken in a limiting sense, and the scope of the present disclosure is defined by the appended claims.

It is understood that a disclosure in connection with a described method may also hold true for a corresponding device or system configured to perform the method and vice versa. For example, if a specific method step is described, a corresponding device or apparatus may include a unit to perform the described method step, even if such unit is not explicitly described or illustrated in the figures. Further, it is understood that the features of the various exemplary aspects described herein may be combined with each other, unless specifically noted otherwise.

Figure 1:
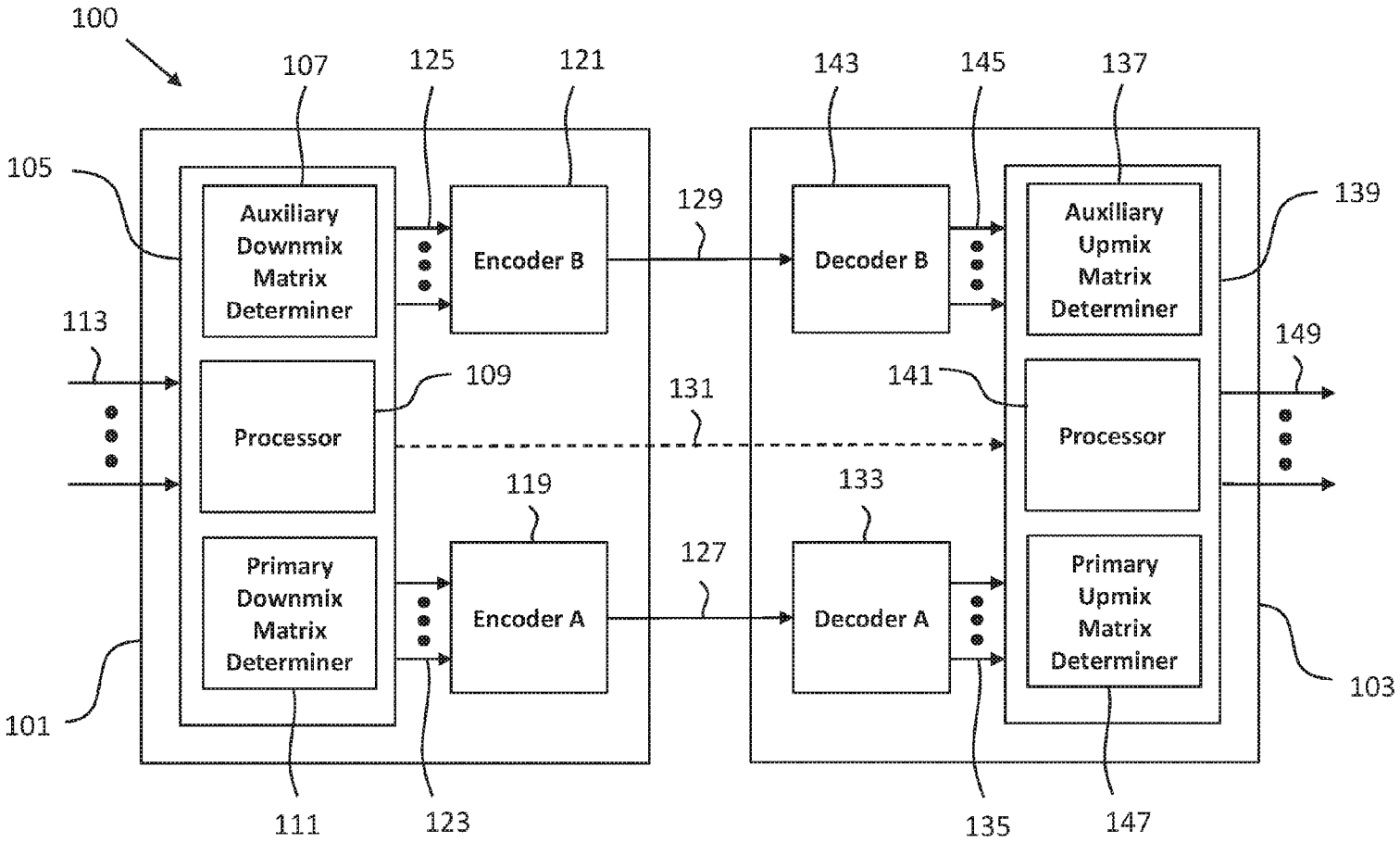
FIG. 1 shows a schematic diagram of an audio signal downmixing apparatus according to an embodiment and an audio signal upmixing apparatus according to an embodiment as part of an audio signal processing system.

FIG. 1 shows a schematic diagram of an audio signal downmixing apparatus 105 according to an embodiment as part of an audio signal processing system 100.

The audio signal downmixing apparatus 105 is configured to processing an input audio signal comprising a plurality of input channels 113 into an output audio signal comprising a plurality of primary output channels 123 and at least one auxiliary output channel 125 using a downmix matrix D, wherein the downmix matrix D comprises a primary downmix matrix $D_U$ for providing the plurality of primary output channels 123 and an auxiliary downmix matrix $D_W$ for providing the at least one auxiliary output channel 125. In an embodiment, the multichannel input audio signal 113 comprises Q input channels.

The audio signal downmixing apparatus 105 comprises an auxiliary downmix matrix determiner 107 configured to determine the auxiliary downmix matrix $D_W$ providing the at least one auxiliary output channel 125. The auxiliary downmix matrix determiner 107 is configured to determine the auxiliary downmix matrix $D_W$ by (i) computing a plurality of eigenvectors of a covariance matrix COV defined by the plurality of input channels 113 of the input audio signal, (ii) determining for at least one eigenvector of the plurality of eigenvectors of the covariance matrix COV a subspace angle between the at least one eigenvector and a vector defined by a column of the primary downmix matrix $D_U$ providing the plurality of primary output channels 123, (iii) selecting at least one eigenvector from the plurality of eigenvectors based on the subspace angle and a preset threshold angle $\theta_{MIN}$, and (iv) defining at least one column of the auxiliary downmix matrix $D_W$ by the at least one selected eigenvector.

The audio signal downmixing apparatus 105 further comprises a processor 109 configured to process the input audio signal using the downmix matrix D into the output audio signal. The downmix matrix D comprises the primary downmix matrix $D_U$ providing the plurality of primary output channels 123 and the auxiliary downmix matrix $D_W$ providing the at least one auxiliary output channel 125. Mathematically, the downmix matrix D can be expressed as $D=[D_U|D_W]$, i.e. as a sort of "concatenation" of the primary downmix matrix $D_U$ and the auxiliary downmix matrix $D_W$. In an embodiment, the downmix matrix D is configured to map the Fourier coefficients associated with the plurality of input channels 113 of the input audio signal into a plurality of Fourier coefficients of the primary output channels 123 and the at least one auxiliary output channel 125 of the output audio signal. In an embodiment, the size of the primary downmix matrix $D_U$ is determined by the number of input channels 113 of the input audio signal and the number of primary output channels 123 of the output audio signal. In an embodiment, the size of the auxiliary downmix matrix $D_W$ is determined by the number of input channels 113 of the input audio signal and the number of auxiliary output channels 125 of the output audio signal.

In an embodiment, the processor 109 is configured to process the input audio signal for each of the plurality of input channels 113 in a frame-wise manner, i.e. in form of a plurality of input audio signal time frames, wherein an audio signal time frame can have a length of, for instance, about 10 to 40 ms per channel. In an embodiment, subsequent input audio signal time frames can be partially overlapping. In an embodiment, the multichannel input audio signal 113 is processed in the frequency domain. In an embodiment, an input audio signal time frame of a channel of the multichannel input audio signal 113 is transformed into the frequency domain by means of a discrete Fourier transformation, in particular a FFT, yielding a plurality of Fourier coefficients at a plurality of frequency bins for the plurality of input audio signal time frames and the plurality of input channels 113 of the input audio signal.

In an embodiment, the audio signal downmixing apparatus 105 further comprises a primary downmix matrix determiner 111 configured to determine the primary downmix matrix $D_U$ on the basis of a fixed beamformer method, an adaptive beamformer method or a similar method. As these beamformer methods are known to the person skilled in the art, they will not be described in greater detail herein.

In an embodiment where the multichannel audio input signal 113 is processed in a frame-wise manner, the auxiliary downmix matrix determiner 107 is configured to determine the covariance matrix COV defined by the plurality of input channels 113 of the input audio signal by determining coefficients $c_{xy}$ of the covariance matrix COV for a given input audio signal time frame n of the plurality of input audio signal time frames and for a given frequency bin j of the plurality of frequency bins using the following equation:

$$c_{xy}(n,j)=E\{j_x j_y^*\},$$

where E{ } denotes an expectation operator, * denotes the complex conjugate and x and y range from 1 to the number of input channels Q.

In another embodiment where the multichannel audio input signal 113 is processed in a frame-wise manner, the auxiliary downmix matrix determiner 107 is configured to determine the covariance matrix COV defined by the plurality of input channels 113 of the input audio signal by determining the coefficients $c_{xy}$ of the covariance matrix COV for a given input audio signal time frame n of the plurality of input audio signal time frames and for a given frequency bin j of the plurality of frequency bins using the following equation:

$$c_{xy}(n,j)=\beta\cdot c_{xy}(n-1,j)+(1-\beta)\cdot\hat{c}_{xy}(n,j),$$

where β denotes a forgetting factor with $0\leq\beta<1$ and $\hat{c}_{xy}(n,j)$ denotes the real part of $E\{j_x\cdot j_y^*\}$.

In an embodiment, in order to reduce the computational complexity the Fourier coefficients can be grouped into B different bands based on certain psychoacoustical scales, such as the Bark scale or the Mel scale, and the determination of the covariance matrix COV can be performed per band b, where b ranges from 1 to B. In this case, a simplified covariance matrix can be used having the following coefficients by performing e.g., an addition:

$$\bar{c}_{xy,b}(n,\ j)=\sum_{j\in b}c_{xy}(n,\ j).$$

This grouping into B bands reduces the computational complexity by only taking a subset of the overall Fourier coefficients.

In an embodiment, the auxiliary downmix matrix determiner 107 is configured to determine the eigenvectors of the covariance matrix COV for a given input audio signal time frame n of the plurality of input audio signal time frames and for a given frequency bin j of the plurality of frequency bins by means of an eigenvalue decomposition (EVD), i.e.

$$COV(n,j)=U\Lambda U^H,$$

where U is a unitary matrix containing the eigenvectors, Λ is a diagonal matrix containing the eigenvalues and UH is the Hermitian transpose of the matrix U.

In an embodiment, the eigenvectors of the covariance matrix COV are calculated iteratively by exploiting the rank-one modification character of the covariance matrix estimate to reduce the computational complexity, because it is not necessary to perform the EVD for each frame n.

Exploiting the nature of the autocorrelation estimation in the transform domain leads to an efficient Karhunen-Loeve Transform (KLT)

$$\Lambda^{(i)}(n)=\alpha\Lambda^{(i)}(n-1)+(1-\alpha)Y^{(i)H}(n)Y^{(i)}(n),$$

$$Y^{(i)}(n):=X^{(i)}(n)U^{(i)}(n-1).$$

where α is a forgetting factor having a value between 0 and 1 and Y and X denote the output and input Fourier coefficients arranged as row vectors of the downmix operation performed by the matrix U.

The estimation is based on a rank-one modification of a diagonal matrix. It has been shown in the literature that the eigenvalues of $\Lambda^{(i)}(n)$ are the zeros of the function $$w(\lambda):=1+(1-\alpha)\cdot\sum_{q=1}^{Q}\frac{y_q^2}{\alpha\lambda_q^{(i)}(n-1)-\lambda},$$

$$w(\lambda)=0 \text{ for } \lambda\in\{\lambda_q^{(i)}(n)\mid\lambda_q^{(i)}(n) \text{ is an eigen value of the modified matrix } \Lambda^{(i)}(n)\}$$

The zeros of the function w(λ) can be found iteratively. However, the convergence of the search process is quadratic.

Once the eigenvalues are computed, the eigenvectors of the modified spatio-temporal transformed autocorrelation matrix GUq of Λ(i)(n) can be explicitly computed by means of the following equations:

$$G_{Uq} = \frac{Y^{(i)}(n)\Lambda_q^{(i)-1}(n)}{\left\|Y^{(i)}(n)\Lambda_q^{(i)-1}(n)\right\|},$$

$$\Lambda_q^{(i)}(n) := \Lambda_q^{(i)}(n-1) - \lambda_q^{(i)}(n) \cdot I_{M\times M}$$

In an embodiment, the auxiliary downmix matrix determiner 107 is configured to determine the subspace angle by determining the smallest angle of a plurality of angles between each eigenvector of the plurality of eigenvectors of the covariance matrix COV and the plurality of vectors defined by the columns of the primary downmix matrix $D_U$.

In an embodiment, the auxiliary downmix matrix determiner 107 is configured to select eigenvectors from the plurality of eigenvectors of the covariance matrix COV based on the subspace angle and a preset threshold angle $\theta_{MIN}$ by selecting eigenvectors, for which the subspace angles are bigger than the preset threshold angle $\theta_{MIN}$.

The primary downmix matrix $D_U$ defines a subspace U of the space defined by the downmix matrix D. The auxiliary downmix matrix $D_W$ defines a subspace W of the space defined by the downmix matrix D. The subspace angle between the subspace U and the subspace W is defined by as the minimum angle between all vectors u spanning the subspace U and all vectors w spanning the subspace W, i.e.

$$\theta_1 := \min\left\{\arccos\left(\frac{|\langle u, w\rangle|}{\|u\|\|w\|}\right) \middle| u \in \mathcal{U}, w \in \mathcal{W}\right\} = \angle(u_1, w_1),$$

where <u,w> denotes the dot product of the vectors u and w and ||u|| denotes the norm of the vector u.

An example is given below for the exemplary case M=2 and Q=4 so that the subspace U is spanned by the vectors u1 and u2, i.e. U={u1, u2} and the subspace W is spanned by the vectors w1, w2, w3 and w4, i.e. W={w1, w2, w3, w4}. In an embodiment, the following angles are calculated:

$\theta_1=\angle(u1,w1)$ $\theta_5=\angle(u2,w1)$ $\theta_2=\angle(u1,w2)$ $\theta_6=\angle(u2,w2)$ $\theta_3=\angle(u1,w3)$ $\theta_7=\angle(u2,w3)$ $\theta_4=\angle(u1,w4)$ $\theta_8=\angle(u2,w4)$.

For calculating the subspace angle between the eigenvectors of the covariance matrix and the space spanned by the primary downmix matrix $D_U$, θ is computed between every eigenvector and the columns of the primary downmix matrix $D_U$. In the above example, this leads to the following angles:

$\theta_a=\min(\theta_1,\theta_5)$ $\theta_c=\min(\theta_3,\theta_7)$ $\theta_b=\min(\theta_2,\theta_6)$ $\theta_d=\min(\theta_4,\theta_8)$ The eigenvectors of the covariance matrix are sorted by decreasing subspace angle, where those having the larger angles are preferably selected for defining the auxiliary downmix matrix D. For example, in the case $\theta_c>\theta_a>\theta_b>\theta_d$ at least the eigenvector w3 associated with the angles $\theta_3$ and $\theta_7$ will be selected as part of the auxiliary downmix matrix $D_W$. As already mentioned above, the number of selected eigenvectors for the auxiliary downmix matrix $D_W$ corresponds to the number of auxiliary output channels 125.

As already mentioned above, the above described embodiments of the audio signal downmixing apparatus 105 can be implemented as a component of an encoding apparatus 101 of the audio signal processing system 100 shown in FIG. 1. As already described above, the audio signal downmixing apparatus 105 of the encoding apparatus 101 receives as input the input audio signal comprising Q input audio signal channels 113.

As described in detail above, the audio signal downmixing apparatus 105 processes on the basis of the downmix matrix D the Q channels of the multichannel input audio signal 113 and provides M primary output channels 123 of the audio output signal and up to Q-M auxiliary output channels 125 of the audio output signal.

The encoding apparatus 101 further comprises an encoder A 119 and another encoder B 121. The encoder A 119 receives as an input the M primary output channels 123 provided by the audio signal downmixing apparatus 105. The other encoder B 121 receives as an input the up to Q-M auxiliary output channels 125 provided by the audio signal downmixing apparatus 105.

The encoder A 119 is configured to encode the M primary output channels 123 provided by the audio signal downmixing apparatus 105 into a first bit stream 127. The other encoder B 121 is configured to encode the up to Q-M auxiliary output channels 125 provided by the audio signal downmixing apparatus 105 into a second bit stream 129. In an embodiment, the encoder A 119 and the other encoder B 121 can be implemented as a single encoder providing as an output a single bit stream.

The first bit stream 127 and the second bit stream 129 are provided as inputs to a decoding apparatus 103 of the audio signal processing system 100 shown in FIG. 1. The decoding apparatus 103 comprises corresponding decoders, namely a decoder A 133 and another decoder B 143, for decoding the first bit stream 127 and the second bit stream 129, respectively.

The decoder A 133 is configured to decode the first bit stream 127 such that the M primary input channels 135 provided by the decoder A 133 as output correspond to the M primary output channels 123 provided by the audio signal downmixing apparatus 105, i.e. such that the M primary input channels 135 provided by the decoder A 133 as output are essentially identical to the M primary output channels 123 provided by the audio signal downmixing apparatus 105 or a degraded version thereof (in case of a lossy codec implemented in the encoder A 119 and the decoder A 133).

The other decoder B 143 is configured to decode the second bit stream 129 such that the up to Q-M auxiliary input channels 145 provided by the other decoder B 143 as output correspond to the up to Q-M auxiliary output channels 125 provided by the audio signal downmixing apparatus 105, i.e. such that the up to Q-M auxiliary input channels 145 provided by the other decoder B 143 as output are essentially identical to the up to Q-M auxiliary output channels 125 provided by the audio signal downmixing apparatus 105 or a degraded version thereof (in case of a lossy codec implemented in the other encoder B 121 and the other decoder B 143).

In the embodiment shown in FIG. 1, the decoding apparatus 103 comprises an audio signal upmixing apparatus 139. In an embodiment, the audio signal upmixing apparatus 139 and/or the components thereof are configured to perform essentially the inverse operation of the audio signal downmixing apparatus 105 and/or the components thereof to generate an output audio signal 149. To this end, the audio signal upmixing apparatus 139 can comprise an auxiliary upmix matrix determiner 137, a processor 141 and a primary upmix matrix determiner 147. In an embodiment, the processor 141 essentially performs the inverse operations (by means of a generalized-inverse method, e.g., pseudo-inverse) of the processor 109 of the audio signal downmixing apparatus 105 of the encoding apparatus 101. In an embodiment, the auxiliary upmix matrix determiner 137 could be configured to determine an auxiliary upmix matrix on the basis of the eigenvectors of the covariance matrix COV analogous to the determination of the auxiliary downmix matrix $D_W$ by the auxiliary downmix matrix determiner 107, which has been described in great detail further above. In an embodiment, any additional data that the audio signal upmixing apparatus 139 can use for generating the output audio signal 149, such as metadata, can be transmitted via a bit stream 131. In an embodiment the audio signal downmixing apparatus 105 can provide the covariance matrix COV via the bit stream 131 to the audio signal upmixing apparatus 139 of the decoding apparatus for generating the output audio signal 149. In an embodiment the audio signal downmixing apparatus 105 can provide the (selected) eigenvectors of the covariance matrix COV instead of the covariance matrix COV itself via the bit stream 131 to the audio signal upmixing apparatus 139 of the decoding apparatus for generating the output audio signal 149. The bit stream 131 can be encoded. An additional signal processing tool, i.e., remix (e.g., panning and wave field synthesis), can be further applied to the output audio signal 149 to obtain the targeted desired output audio signal. As the person skilled in the art will appreciate, the M primary output channels 135 provided by the decoder A 133 represent the M primary input channels 135 and the up to Q-M auxiliary output channels 145 provided by the other decoder B 143 represent the up to Q-M auxiliary input channels 145 of the input audio signal processed by the audio signal upmixing apparatus 139.

Figure 2:
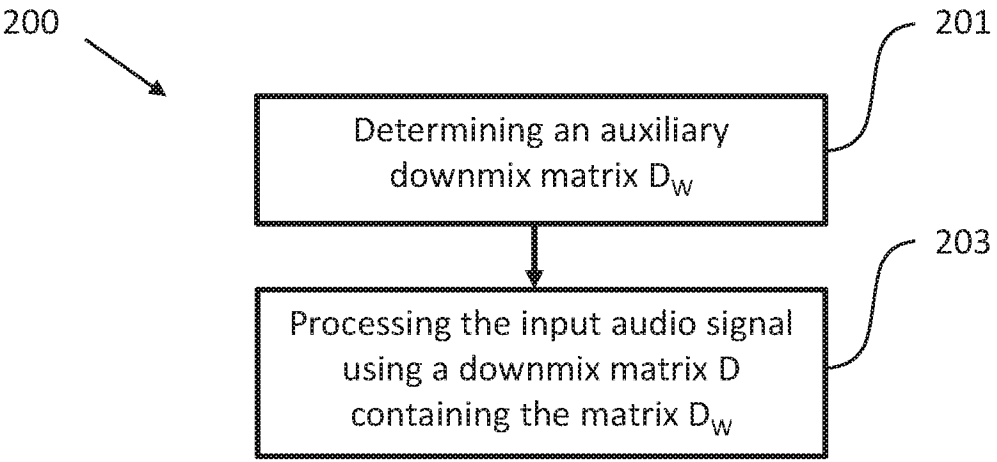
FIG. 2 shows a schematic diagram of an audio signal downmixing method according to an embodiment.

FIG. 2 shows a schematic diagram of an embodiment of an audio signal processing method 200 for processing an input audio signal comprising a plurality of input channels 113 into an output audio signal comprising a plurality of primary output channels 123 and at least one auxiliary output channel 125.

Figure 3:
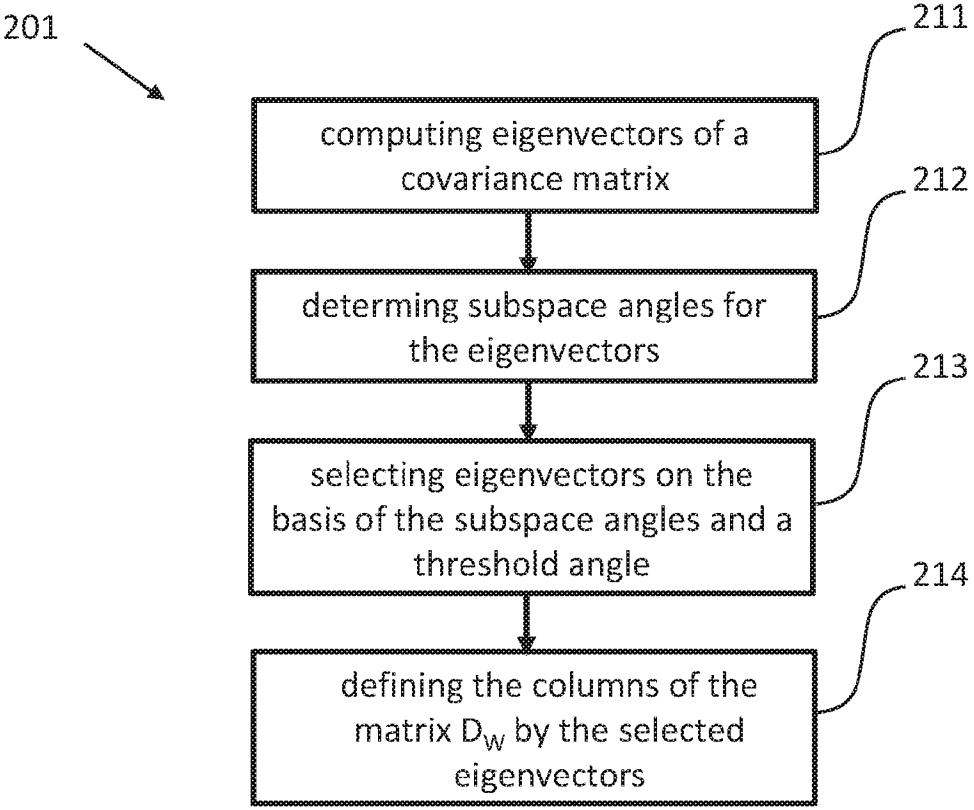
FIG. 3 shows in implementation of the audio signal downmixing method according to an embodiment.

The audio signal downmixing method 200 comprises a step 201 of determining an auxiliary downmix matrix $D_W$ providing the at least one auxiliary output channel 125. Preferably the step 201 of determining an auxiliary downmix matrix $D_W$ is implemented by the steps shown in FIG. 3, namely by computing (211) a plurality of eigenvectors of a covariance matrix COV defined by the plurality of input channels 113 of the input audio signal, determining (212) for at least one eigenvector of the plurality of eigenvectors of the covariance matrix COV a subspace angle between the at least one eigenvector and a vector defined by a column of the primary downmix matrix $D_U$ providing the plurality of primary output channels, selecting (213) at least one eigenvector from the plurality of eigenvectors based on the subspace angle and a preset threshold angle $\theta_{MIN}$, and defining (214) at least one column of the auxiliary downmix matrix $D_W$ by at least one selected eigenvector.

Moreover, the audio signal downmixing method 200 comprises a step 203 of processing the input audio signal using a downmix matrix D into the output audio signal, wherein the downmix matrix D comprises a primary downmix matrix $D_U$ providing the plurality of primary output channels 123 and the auxiliary downmix matrix $D_W$ providing the at least one auxiliary output channel 125.

Embodiments of the invention may be implemented in a computer program for running on a computer system, at least including code portions for performing steps of a method according to the invention when run on a programmable apparatus, such as a computer system or enabling a programmable apparatus to perform functions of a device or system according to the invention.

A computer program is a list of instructions such as a particular application program and/or an operating system. The computer program may for instance include one or more of: a subroutine, a function, a procedure, an object method, an object implementation, an executable application, an applet, a servlet, a source code, an object code, a shared library/dynamic load library and/or other sequence of instructions designed for execution on a computer system.

The computer program may be stored internally on computer readable storage medium or transmitted to the computer system via a computer readable transmission medium. All or some of the computer program may be provided on transitory or non-transitory computer readable media permanently, removably or remotely coupled to an information processing system. The computer readable media may include, for example and without limitation, any number of the following: magnetic storage media including disk and tape storage media; optical storage media such as compact disk media (e.g., CD-ROM, CD-R, etc.) and digital video disk storage media; nonvolatile memory storage media including semiconductor-based memory units such as FLASH memory, EEPROM, EPROM, ROM; ferromagnetic digital memories; MRAM; volatile storage media including registers, buffers or caches, main memory, RAM, etc.; and data transmission media including computer networks, point-to-point telecommunication equipment, and carrier wave transmission media, just to name a few.

A computer process typically includes an executing (running) program or portion of a program, current program values and state information, and the resources used by the operating system to manage the execution of the process. An operating system (OS) is the software that manages the sharing of the resources of a computer and provides programmers with an interface used to access those resources. An operating system processes system data and user input, and responds by allocating and managing tasks and internal system resources as a service to users and programs of the system.

The computer system may for instance include at least one processing unit, associated memory and a number of input/output (I/O) devices. When executing the computer program, the computer system processes information according to the computer program and produces resultant output information via I/O devices.

The connections as discussed herein may be any type of connection suitable to transfer signals from or to the respective nodes, units or devices, for example via intermediate devices. Accordingly, unless implied or stated otherwise, the connections may for example be direct connections or indirect connections. The connections may be illustrated or described in reference to being a single connection, a plurality of connections, unidirectional connections, or bidirectional connections. However, different embodiments may vary the implementation of the connections. For example, separate unidirectional connections may be used rather than bidirectional connections and vice versa. Also, plurality of connections may be replaced with a single connection that transfers multiple signals serially or in a time multiplexed manner. Likewise, single connections carrying multiple signals may be separated out into various different connections carrying subsets of these signals. Therefore, many options exist for transferring signals.

Those skilled in the art will recognize that the boundaries between logic blocks are merely illustrative and that alternative embodiments may merge logic blocks or circuit elements or impose an alternate decomposition of functionality upon various logic blocks or circuit elements. Thus, it is to be understood that the architectures depicted herein are merely exemplary, and that in fact many other architectures can be implemented which achieve the same functionality.

Thus, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality.

Furthermore, those skilled in the art will recognize that boundaries between the above described operations merely illustrative. The multiple operations may be combined into a single operation, a single operation may be distributed in additional operations and operations may be executed at least partially overlapping in time. Moreover, alternative embodiments may include multiple instances of a particular operation, and the order of operations may be altered in various other embodiments.

Also for example, the examples, or portions thereof, may implemented as soft or code representations of physical circuitry or of logical representations convertible into physical circuitry, such as in a hardware description language of any appropriate type.

Also, the invention is not limited to physical devices or units implemented in nonprogrammable hardware but can also be applied in programmable devices or units able to perform the desired device functions by operating in accordance with suitable program code, such as mainframes, minicomputers, servers, workstations, personal computers, notepads, personal digital assistants, electronic games, automotive and other embedded systems, cell phones and various other wireless devices, commonly denoted in this application as 'computer systems'.

However, other modifications, variations and alternatives are also possible. The specifications and drawings are, accordingly, to be regarded in an illustrative rather than in a restrictive sense.

The invention claimed is:

1. An audio signal downmixing apparatus (105) for processing an input audio signal including a plurality of input channels (113), comprising:

an auxiliary downmix matrix determiner (107) configured to determine an auxiliary downmix matrix ($D_W$) by:

computing a plurality of eigenvectors of a covariance matrix (COV) defined by the plurality of input channels (113) of the input audio signal;

determining for at least one eigenvector of the plurality of eigenvectors of the covariance matrix (COV) a subspace angle between the at least one eigenvector and a vector defined by a column of a primary downmix matrix ($D_U$);

selecting at least one eigenvector from the plurality of eigenvectors based on the subspace angle and a preset threshold angle $\theta_{MIN}$; and defining at least one column of the auxiliary downmix matrix ($D_W$) by the at least one selected eigenvector; and a processor (109) configured to process the input audio signal into an output audio signal including a plurality of primary output channels (123) and at least one auxiliary output channel (125) using a downmix matrix (D), wherein the downmix matrix (D) includes the primary downmix matrix ($D_U$) for providing the plurality of primary output channels (123) and the auxiliary downmix matrix ($D_W$) for providing the at least one auxiliary output channel (125).

2. The audio signal downmixing apparatus (105) of claim 1, wherein the auxiliary downmix matrix determiner (107) is configured to determine the subspace angle by determining the smallest angle of a plurality of angles between each eigenvector of the plurality of eigenvectors of the covariance matrix (COV) and the plurality of vectors defined by the columns of the primary downmix matrix ($D_U$).

3. The audio signal downmixing apparatus (105) of claim 2, wherein the auxiliary downmix matrix determiner (107) is configured to select eigenvectors from the plurality of eigenvectors based on the subspace angle and the preset threshold angle $\theta_{MIN}$ by selecting eigenvectors, for which the subspace angles are bigger than the preset threshold angle $\theta_{MIN}$.

4. The audio signal downmixing apparatus (105) of claim 1, wherein the size of the primary downmix matrix ($D_U$) is determined by the number of input channels (113) of the input audio signal and the number of primary output channels (123) of the output audio signal.

5. The audio signal downmixing apparatus (105) of claim 1, wherein the size of the auxiliary downmix matrix ($D_W$) is determined by the number of auxiliary output channels (125) of the output audio signal.

6. The audio signal downmixing apparatus (105) of claim 1, the audio signal downmixing apparatus (105) further comprising a primary downmix matrix determiner (111) configured to determine the primary downmix matrix ($D_U$) on the basis of a fixed beamformer method or an adaptive beamformer method.

7. The audio signal downmixing apparatus (105) of claim 1, wherein the processor (109) is configured to process the input audio signal for each of the plurality of input channels (113) in the form of a plurality of input audio signal time frames and wherein the processor (109) is further configured to process the input audio signal by determining for each of the plurality of input channels (113) discrete Fourier transforms of the plurality of input audio signal time frames resulting in a plurality of Fourier coefficients at a plurality of frequency bins for the plurality of input audio signal time frames and the plurality of input channels (113) of the input audio signal.

8. The audio signal downmixing apparatus (105) of claim 7, wherein the auxiliary downmix matrix determiner (107) is configured to determine the auxiliary downmix matrix ($D_W$) by determining coefficients $c_{xy}$ of the covariance matrix (COV) for a given input audio signal time frame n of the plurality of input audio signal time frames and for a given frequency bin j of the plurality of frequency bins using the following equation:

$$c_{xy}(n,j)=E\{j_x j_y^*\}$$

where E{ } denotes an expectation operator, $j_x$ denotes a Fourier coefficient at frequency bin j for input channel x of the input audio signal, * denotes the complex conjugate and x and y range from 1 to the number of input channels (113).

9. The audio signal downmixing apparatus (105) of claim 7, wherein the auxiliary downmix matrix determiner (107) is configured to determine the auxiliary downmix matrix ($D_W$) by determining coefficients $c_{xy}$ of the covariance matrix (COV) for a given input audio signal time frame n of the plurality of input audio signal time frames and for a given frequency bin j of the plurality of frequency bins using the following equation:

$$c_{xy}(n,j)=\beta\cdot c_{xy}(n-1,j)+(1-\beta)\cdot\hat{c}_{xy}(n,j)$$

where β denotes a forgetting factor with $0\leq\beta<1$, $\hat{c}_{xy}(n,j)$ denotes the real part of $E\{j_x \cdot j_y^*\}$, $j_x$ denotes a Fourier coefficient at frequency bin j for input channel x of the input audio signal, * denotes the complex conjugate and x and y range from 1 to the number of input channels (113).

10. The audio signal downmixing apparatus (105) of claim 1, wherein the auxiliary downmix matrix determiner (107) is configured to compute the plurality of eigenvectors of the covariance matrix (COV) defined by the plurality of input channels (113) of the input audio signal by means of an eigenvalue decomposition of the covariance matrix (COV).

11. The audio signal downmixing apparatus (105) of claim 1, wherein the plurality of input channels (113) comprise Q input channels, the plurality of primary output channels (123) comprise M primary output channels and the at least one auxiliary output channel (125) comprises up to Q-M auxiliary output channels.

12. An audio signal downmixing method (200), comprising:

receiving an input audio signal including a plurality of input channels (113);

computing (211) a plurality of eigenvectors of a covariance matrix (COV) defined by the plurality of input channels (113) of the input audio signal;

determining (212) for at least one eigenvector of the plurality of eigenvectors of the covariance matrix (COV) a subspace angle between the at least one eigenvector and a vector defined by a column of a primary downmix matrix ($D_U$);

selecting (213) at least one eigenvector from the plurality of eigenvectors based on the subspace angle and a preset threshold angle $\theta_{MIN}$;

defining (214) at least one column of the auxiliary downmix matrix ($D_W$) by the at least one selected eigenvector; and processing the input audio signal into an output audio signal including a plurality of primary output channels (123) and at least one auxiliary output channel (125) using a downmix matrix (D), wherein the downmix matrix (D) includes the primary downmix matrix ($D_U$) for providing the plurality of primary output channels (123) and the auxiliary downmix matrix ($D_W$) for providing the at least one auxiliary output channel (125).

13. An audio signal upmixing apparatus (139), comprising:

a receiver configured to receive an input audio signal including a plurality of primary input channels (135) and at least one auxiliary input channel (145);

an auxiliary upmix matrix determiner (137) configured to determine an auxiliary upmix matrix by:

obtaining a plurality of eigenvectors of a covariance matrix (COV) of the input audio signal;

determining for at least one eigenvector of the plurality of eigenvectors of the covariance matrix (COV) a subspace angle between the at least one eigenvector and a vector defined by a column of a primary upmix matrix;

selecting at least one eigenvector from the plurality of eigenvectors based on the subspace angle and a preset threshold angle $\theta_{MIN}$; and defining at least one column of the auxiliary upmix matrix by the at least one selected eigenvector; and a processor (141) configured to process the input audio signal into an output audio signal (149) using an upmix matrix, wherein the upmix matrix comprises the primary upmix matrix and the auxiliary upmix matrix.

14. An audio signal upmixing method, comprising:

receiving an input audio signal including a plurality of primary input channels (135) and at least one auxiliary input channel (145); obtaining a plurality of eigenvectors of a covariance matrix (COV) of the input audio signal; determining for at least one eigenvector of the plurality of eigenvectors of the covariance matrix (COV) a subspace angle between the at least one eigenvector and a vector defined by a column of a primary upmix matrix; selecting at least one eigenvector from the plurality of eigenvectors based on the subspace angle and a preset threshold angle θmin; defining at least one column of an auxiliary upmix matrix by the at least one selected eigenvector; and processing the input audio signal into the output audio signal (149) using an upmix matrix, wherein the upmix matrix comprises the primary upmix matrix and the auxiliary upmix matrix.

15. A non-transitory storage medium storing a computer program for performing the audio signal downmixing method (200) of claim 12 when executed on a computer.

16. A non-transitory storage medium storing a computer program for performing the audio signal upmixing method of claim 14 when executed on a computer.

* * * * *